US005620328A

United States Patent [19]

Yamamoto et al.

[11] Patent Number: 5,620,328

[45] Date of Patent: Apr. 15, 1997

[54] CONNECTOR RELEASE MECHANISM

[75] Inventors: Masahiro Yamamoto, Yokohama; Toshimitsu Sonobe, Tokyo, both of Japan

[73] Assignee: Thomas & Betts Corporation, Memphis, Tenn.

[21] Appl. No.: 325,833

[22] Filed: Oct. 19, 1994

[30] Foreign Application Priority Data

Oct. 19, 1993 [JP] Japan ..... 5-261072

[51] Int. Cl.[6] ..... H01R 13/62

[52] U.S. Cl. ..... 439/157; 439/347

[58] Field of Search ..... 439/345–347, 439/153, 157, 160, 372

[56] References Cited

U.S. PATENT DOCUMENTS

| | | | |
|---|---|---|---|
| 625,639 | 5/1899 | Burchell . | |
| 1,302,730 | 5/1919 | Tomlinson et al. . | |
| 3,945,703 | 3/1976 | McCormick . | |
| 4,718,858 | 1/1988 | Godfrey et al. | 439/296 |
| 5,104,330 | 4/1992 | Yagi et al. | 439/157 |
| 5,145,356 | 9/1992 | Minnis | 439/352 |
| 5,174,785 | 12/1992 | Endo et al. | 439/157 |
| 5,230,635 | 7/1993 | Takenouchi et al. | 439/153 |
| 5,238,417 | 8/1993 | Hatagishi | 439/153 |
| 5,330,362 | 7/1994 | Ito et al. | 439/157 |
| 5,344,194 | 9/1994 | Hatagishi et al. | 439/157 |
| 5,373,419 | 12/1994 | Wright | 439/157 |

*Primary Examiner*—P. Austin Bradley
*Assistant Examiner*—Jill Demello
*Attorney, Agent, or Firm*—Michael L. Hoelter; Salvatore J. Abbruzzese

[57] ABSTRACT

A connector comprises first and second housings adapted to be coupled to each other. A pivotal plate is pivotally disposed on one of the housings. A pair of leaf springs is interposed between one of the housings and the pivotal plate. A latch is provided for locking the two housings upon coupling. When the two housings are to be coupled, the pivotal plate is pivoted by the action of the leaf springs. This occurs after the two housings reach an intermediate state of coupling.

14 Claims, 19 Drawing Sheets

CONNECTOR RELEASE MECHANISM

FIELD OF THE INVENTION

The present invention relates to a connector implemented in such a manner that a coupling is not completed in an intermediate coupling state.

BACKGROUND OF THE INVENTION

To prevent intermediate or half fitting of a connector, there is conventionally known a method of reducing the force in insertion of one connector into another connector or providing a mechanism for doubling a force applied to a connector in insertion, thereby facilitating a coupling operation, a method of visually checking a half fit state or electrically detecting connections of contacts, or the like.

When the insertion force applied to the connector is reduced, the connectors are easily disconnected, and the method of doubling the force applied to the connector in insertion of detecting the electrical connections of the contacts complicates the connector structure or requires a special jig of a measurement equipment.

SUMMARY OF THE INVENTION

The present invention eliminates the above conventional drawbacks, and has as its object to provide a connector comprising first and second housings that are coupled to each other, a pivotal plate pivotally provided to one of the two housings, a pair of leaf springs interposed between one housing and the pivotal plate, and latch means for locking the two housings that are coupled to each other.

According to the connector of the present invention, in coupling the two housings, after the two housings reach the intermediate coupling state, the pivotal plate is pivoted by the action of the leaf springs, thereby completely coupling the two housings to each other.

DETAILED DESCRIPTION OF THE PREFERRED EMBODIMENTS

Figure 1:
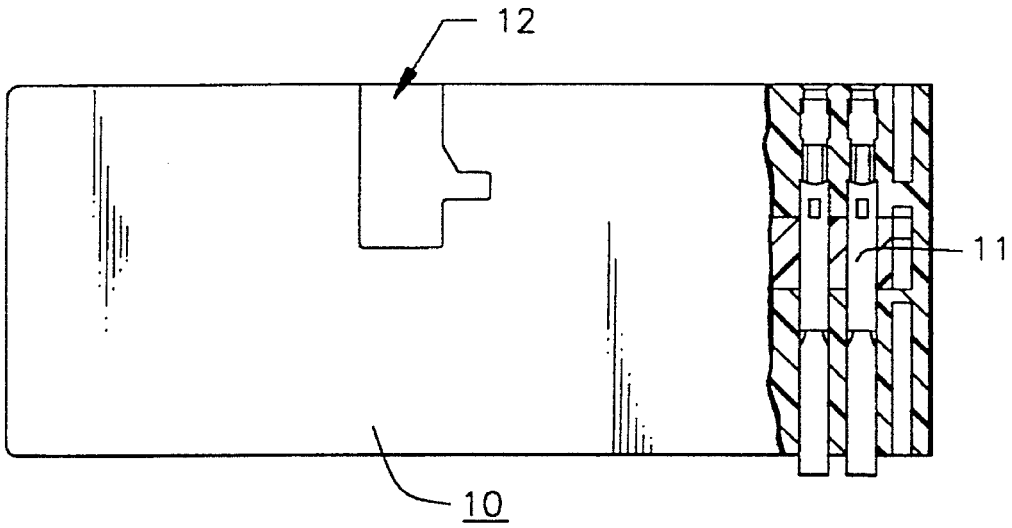
FIG. 1 is a partially cutaway plan view of a male housing (in which female contacts are mounted) of the first embodiment according to the present invention.
Figure 5:
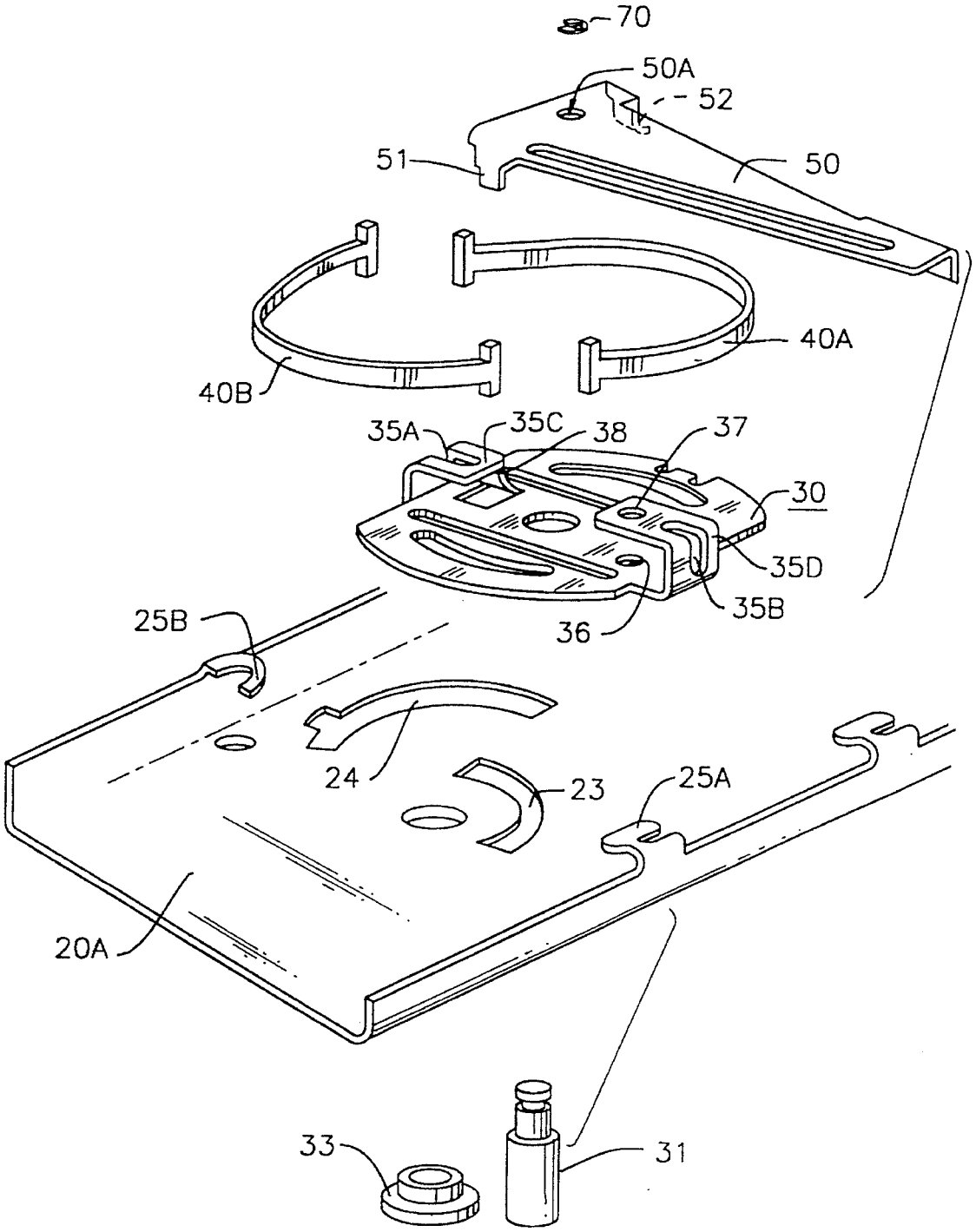
FIG. 5 is an exploded view of a portion of a female connector of the first embodiment.
Figure 6:
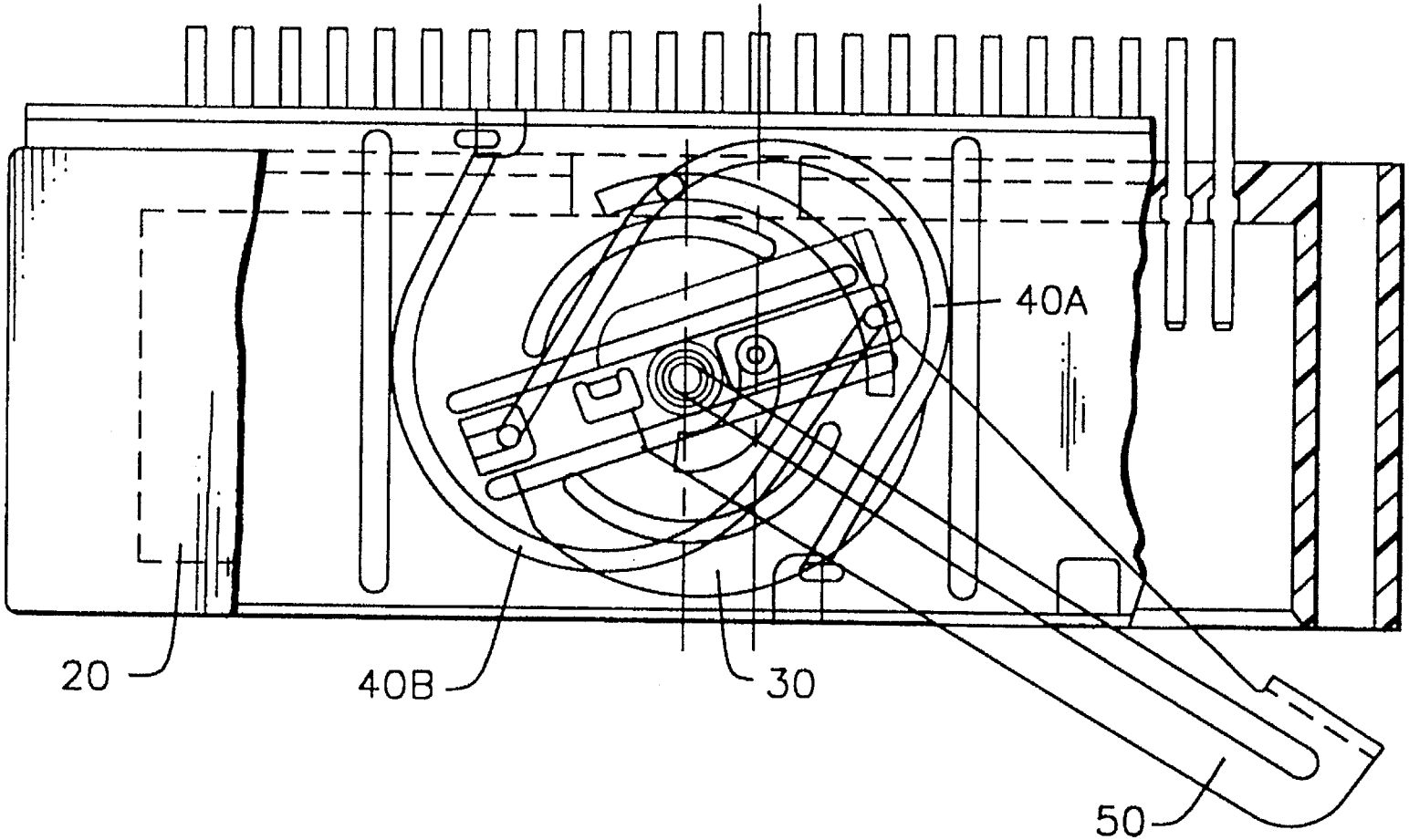
FIG. 6 is a plan view of the female connector of the first embodiment.
Figure 16:
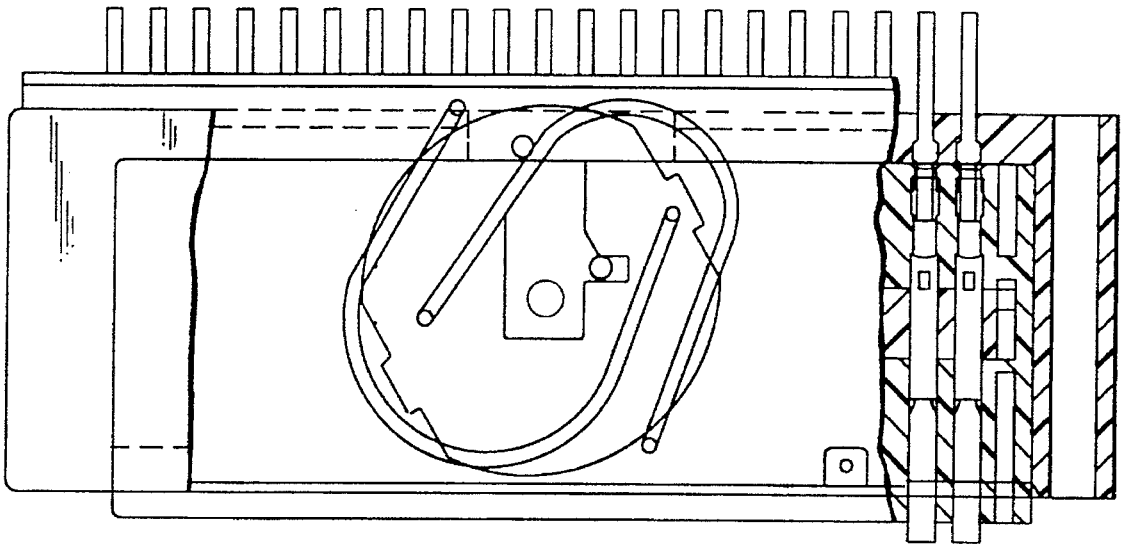
FIG. 16 is a partially cutaway plan view for explaining a coupling step of the connectors of the first embodiment.
Figure 17:
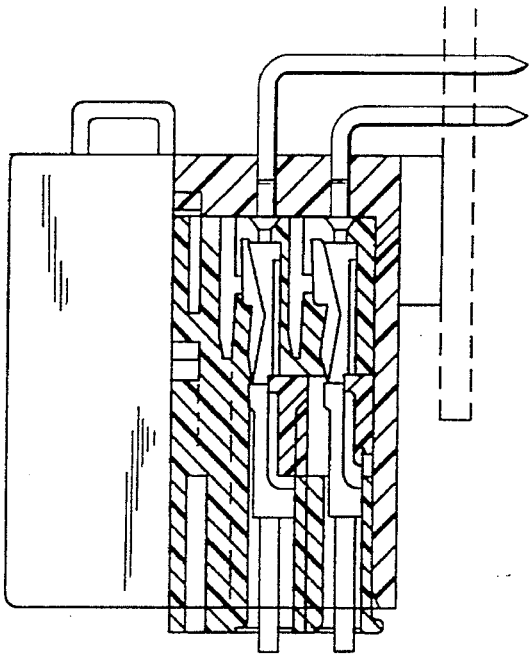
FIG. 17 is a partially cutaway side view for explaining a coupling step of the connectors shown in FIG. 16.
Figure 18:
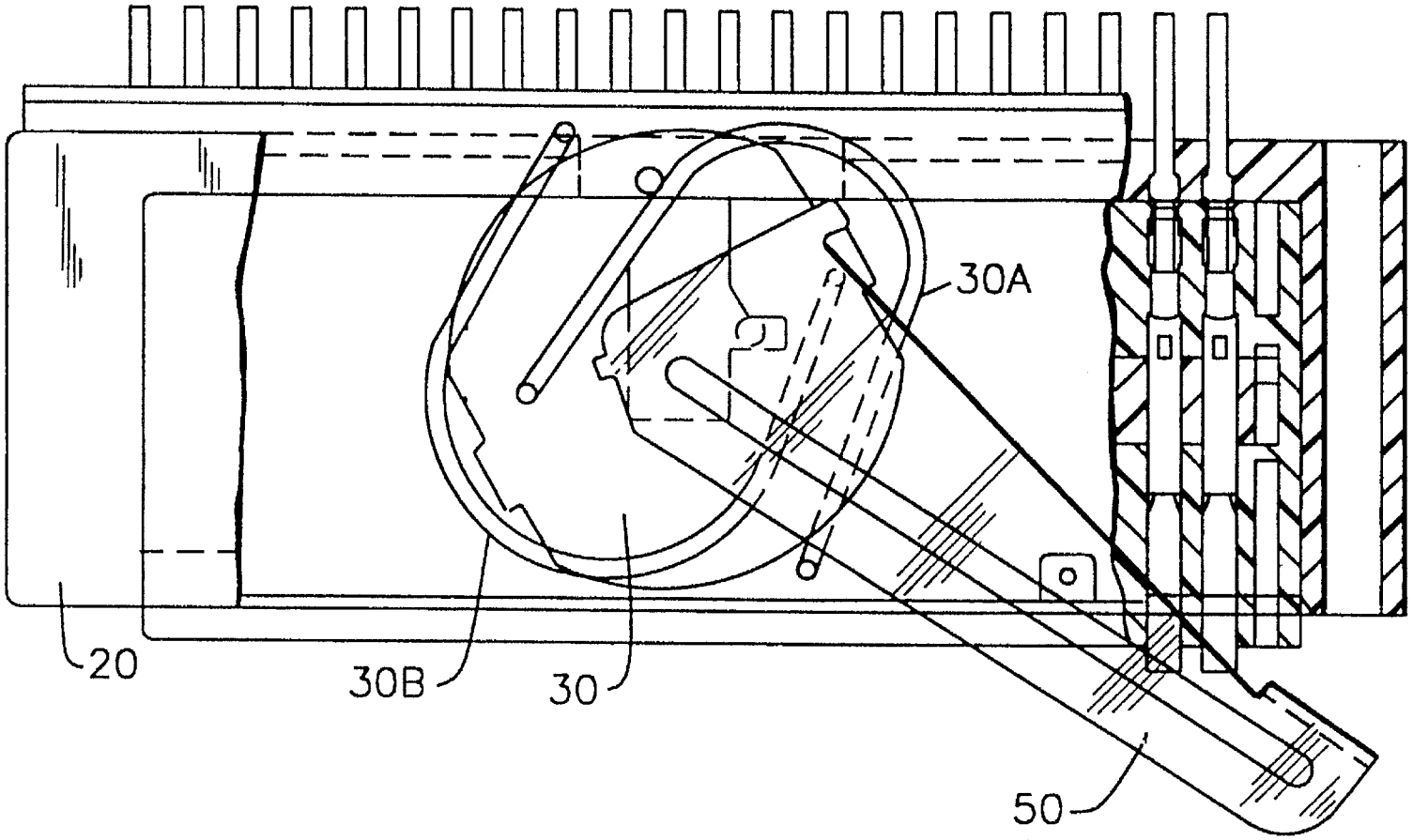
FIG. 18 is a partially cutaway plan view for explaining a step of separating the coupled connectors of the first embodiment.
Figure 19:
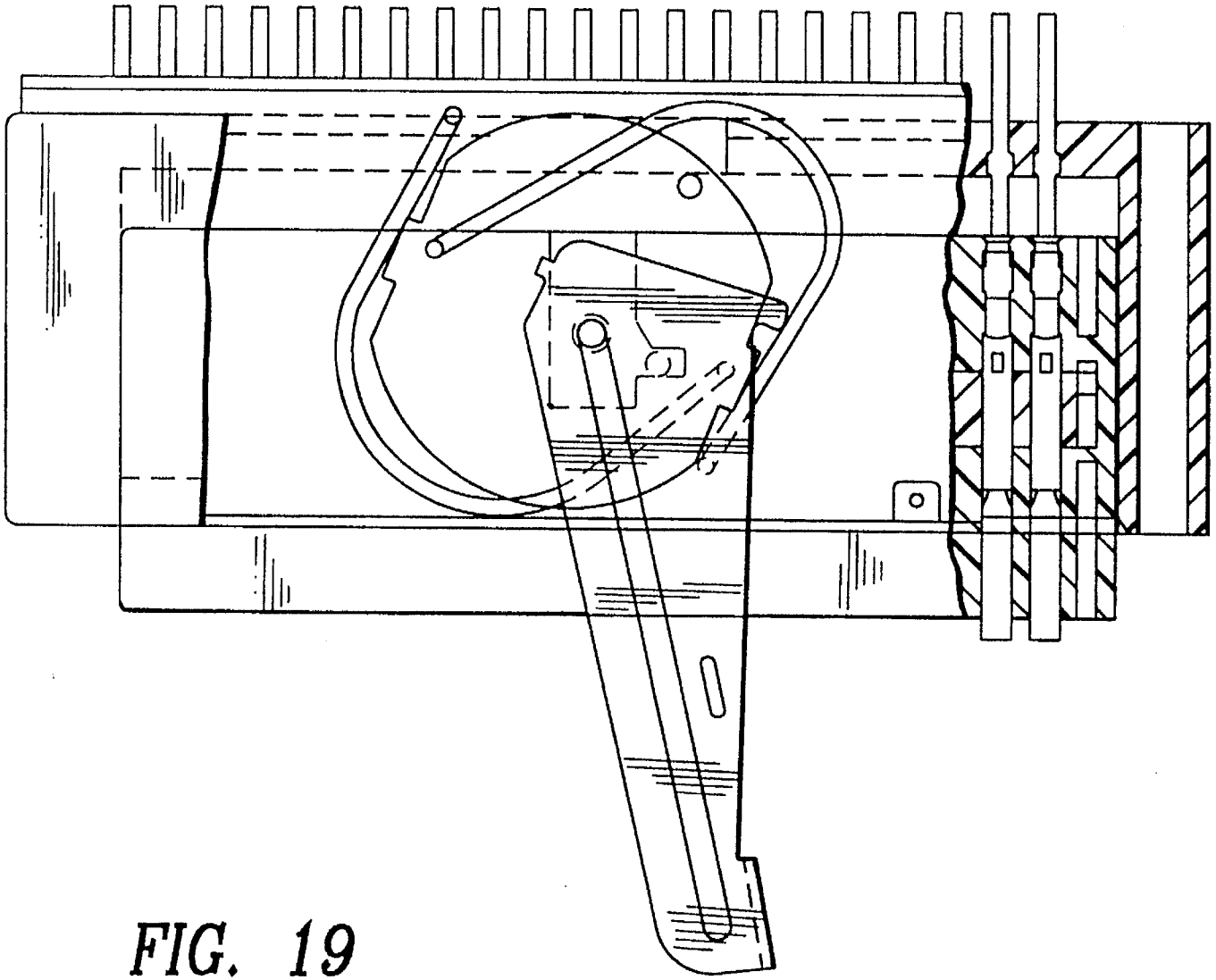
FIG. 19 is a partially cutaway plan view for explaining a step of separating the coupled connectors of the first embodiment.

FIGS. 1 to 22 show the first embodiment of the present invention. FIG. 1 shows a male housing (contacts are female), and FIGS. 1 and 4 show a female housing (contacts are male). FIGS. 5 and 6 shows the male connector having a pivotal plate and the like therein. FIGS. 6 to 15 show a process for coupling the two connectors (housings). FIGS. 16 and 17 show the connectors in a coupled state. FIGS. 18 to 21 show a process for separating the two coupled connectors from each other.

Figure 2:
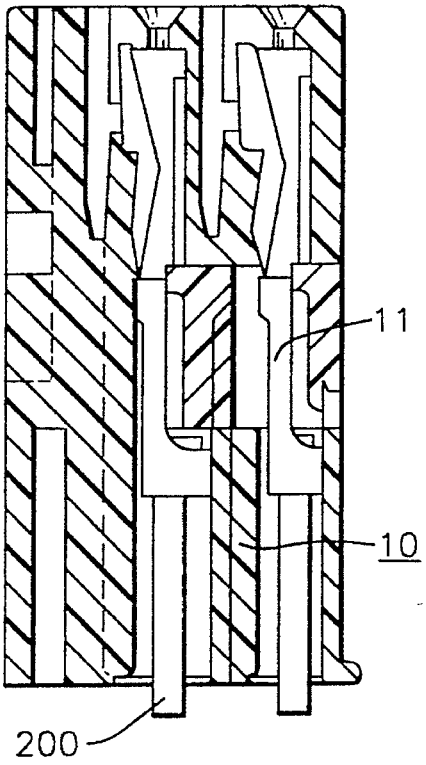
FIG. 2 is a partially cutaway plan view of a male housing shown in FIG. 1.

FIGS. 1 and 2 show a male housing 10. Female contacts 11 whose wires 200 are terminated in the housing extend through the front surface of the housing and are mounted in multi-stage accommodation grooves formed at a predetermined interval in the housing.

Referring to FIGS. 1 and 2, a latch groove 12 is engaged with a female engaging pin 31 (to be described later).

Figure 3:
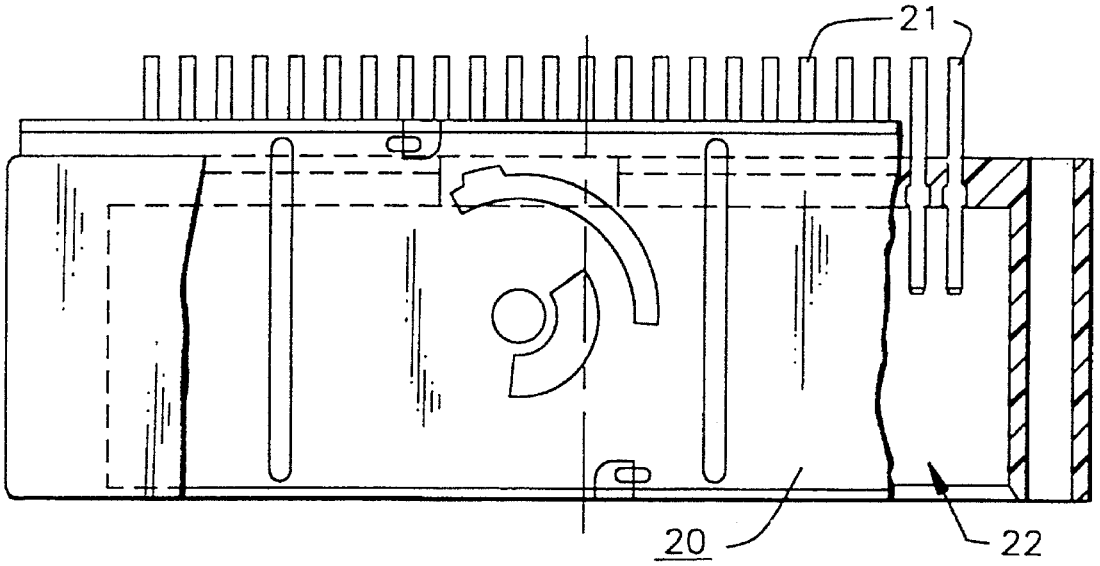
FIG. 3 is a partially cutaway side view of a female housing (in which male contacts are mounted) of the first embodiment.
Figure 4:
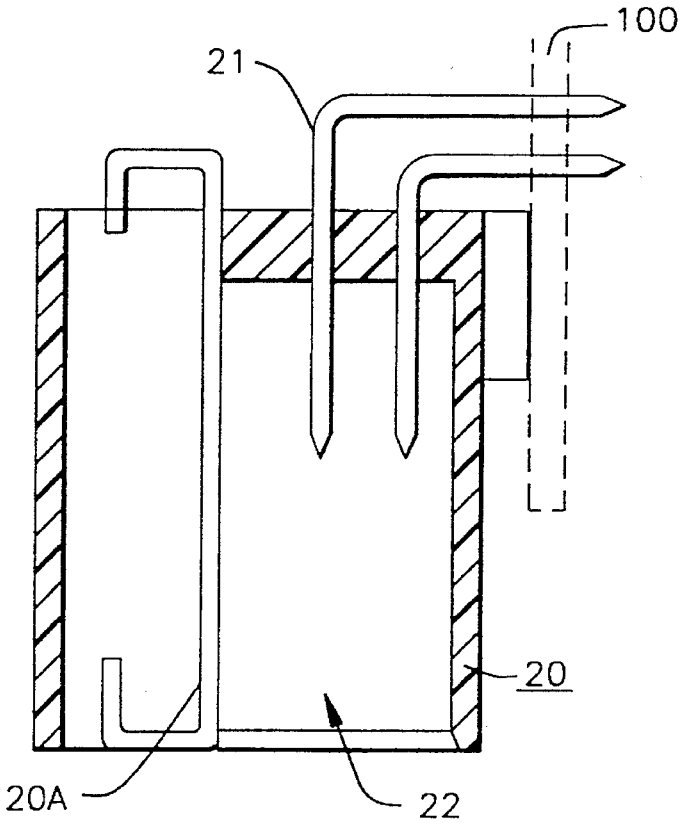
FIG. 4. is a partially cutaway side view of the female housing shown in FIG. 3.

FIGS. 3 and 4 show a female housing 20. A hollow portion 22 for accommodating the male housing is formed in the female housing 20. A large number of male contacts 21 extend through the rear surface of the female housing 20 and extend into the hollow portion. To couple the male and female housings to each other, the male contacts are connected to the corresponding female contacts in the male housing in the hollow portion. Note that the other end of each male contact is connected to a board 100.

FIG. 5 shows a state in which the pivotal plate and the like in the male connector are disassembled. A pivotal plate 30 is pivotally provided to the female housing. Leaf springs 40A and 40B are interposed between the pivotal plate and the female housing. More specifically, the pivotal plate is mounted on a top surface 20A (i.e., a wall surface which forms the hollow portion 22) of the female housing to be pivotal about a pivot 33. One end of the leaf spring 40A is engaged with a ratchet 25A formed on one long side of the top surface of the housing, and the other end of the leaf spring 40A is engaged with a hole 35A formed in an edge of the pivotal plate. Similarly, two ends of the other leaf spring 40B are engaged with a ratchet 26B and a hole 35B formed at positions opposite to the ratchet 26A and the hole 35A, respectively.

In the illustrated embodiment, the two ends of each leaf spring have a pair of projections extending in its widthwise direction. These projections are supported by U-shaped bases 35C and 35D formed at edge portions of the pivotal plate.

The engaging pin 31 extends downward from the bottom surface of the pivotal plate and extends into the hollow portion 22 through a window hole 23 formed in the top surface of the female housing. More specifically, the pin 31 extends through the window hole 23, a through hole 36 of the pivotal plate, a hole 37 of the U-shaped base, and an axial hole 50A of a reset-lever 50 (to be described later) and is fixed by a stop ring 70.

The pivotal plate 30 has a guard pin 32 (not shown in FIG. 5; see FIG. 7) extending into the hollow portion through a guide groove 24 formed in the wall surface defining the hollow portion, the upper portion of the front surface of the male housing presses the guide in extending into the hollow portion, and the guide pin is slid within the guide groove, thereby pivoting the pivotal plate.

Referring to FIG. 5, the reset-lever 50 is pivotal about the pin 31 at the hole 50A. Although will be described in detail later, when the coupled housings are to be separated from each other, an actuator 31 formed at the proximal portion of the lever is brought into contact with a stopper 38 formed on the pivotal plate. Upon pivotal movement of he lever, the pivotal late is pivoted in a direction opposite to that required to couple the two housings.

FIG. 6, shows a state in which the pivotal plate and other members are assembled on the top surface of the female housing.

In the illustrated embodiment, when the two housings are kept separated (see FIG. 6), the pivotal plate receives a force for pivoting plate clockwise. However, the pivotal movements of the engaging pin and the guide pin are prevented by the window hole and the guide groove, respectively. For this reason, the pivotal plate is kept stopped in a state shown in FIG. 6.

After the male and female housings are finally connected to each other, they require a latch means to lock the two housings so as to hold the connected state. In this embodiment, the latch means comprises the engaging pin 31 formed on the pivotal plate of the female housing and the latch groove 12 formed in the female housing.

Figure 7:
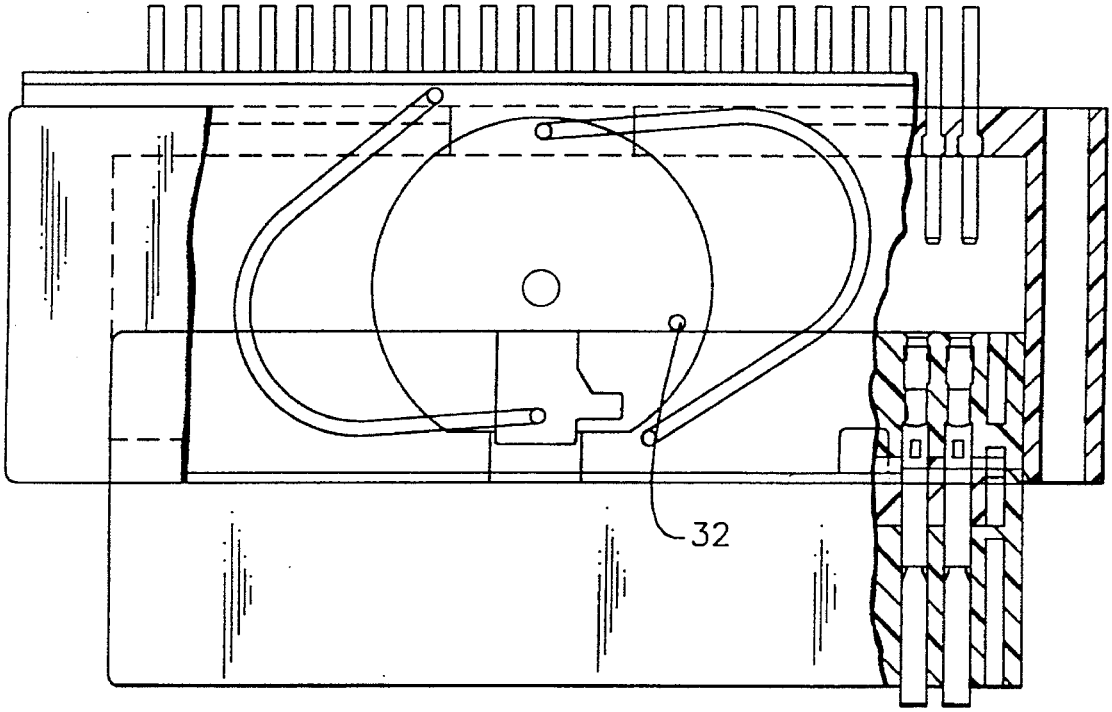
FIG. 7 is a partially cutaway plan view for explaining a coupling step of the connectors of the first embodiment.
Figure 8:
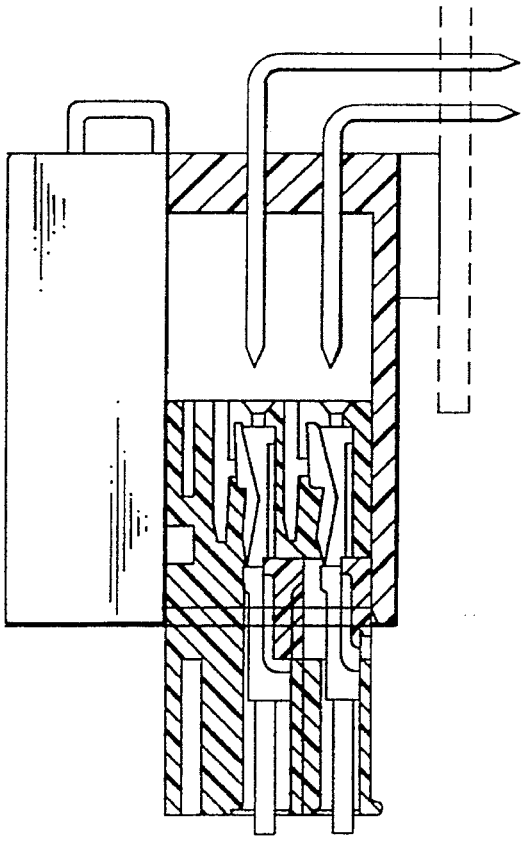
FIG. 8 is a partially cutaway side view for explaining a coupling step of the connectors shown in FIG. 7.

The coupling process of the two connectors (housings) of this embodiment will be described with reference to FIGS. 7 to 17. For the illustrative convenience, the lever 50 is not illustrated. FIGS. 7 and 8 show the first process for coupling the two housings. In this process, the engaging pin 31 of the pivotal plate is simply engaged with the latch groove 12 of the male housing, and the pivotal plate is not yet pivoted.

Figure 9:
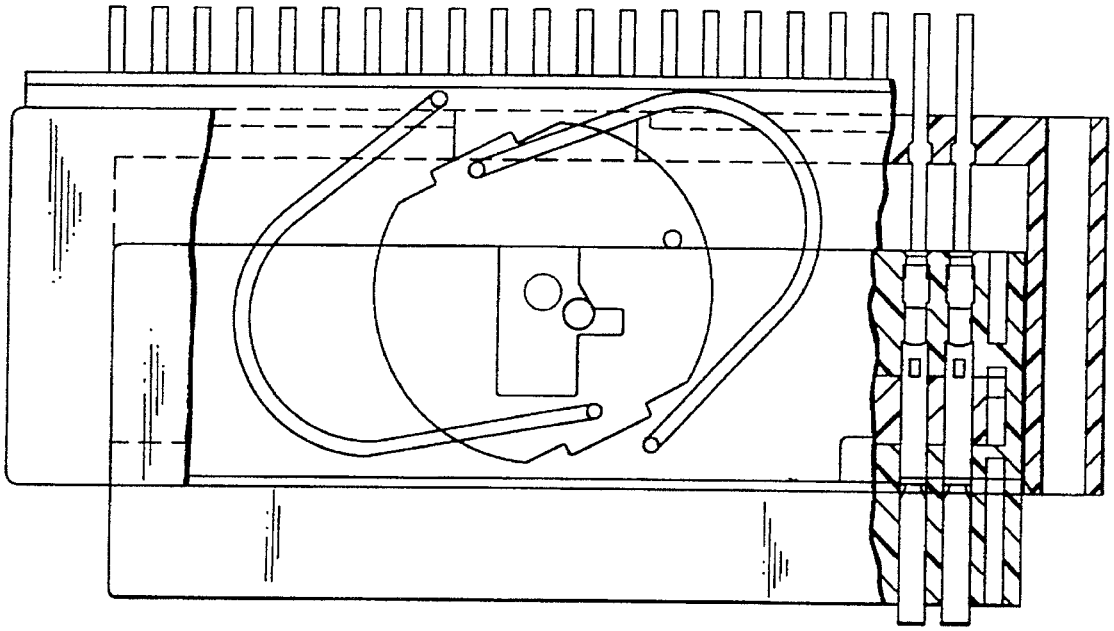
FIG. 9 is a partially cutaway plan view for explaining a coupling step of the connectors of the first embodiment.
Figure 10:
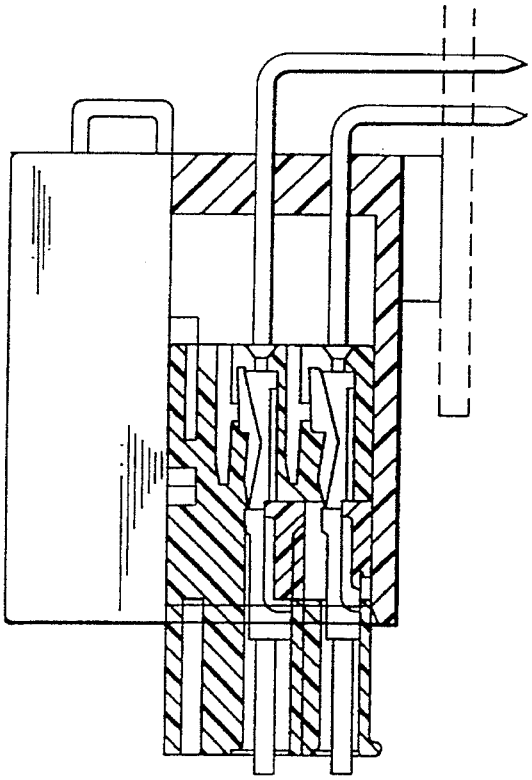
FIG. 10 is a partially cutaway side view for explaining a coupling step of the connectors shown in FIG. 9.
Figure 11:
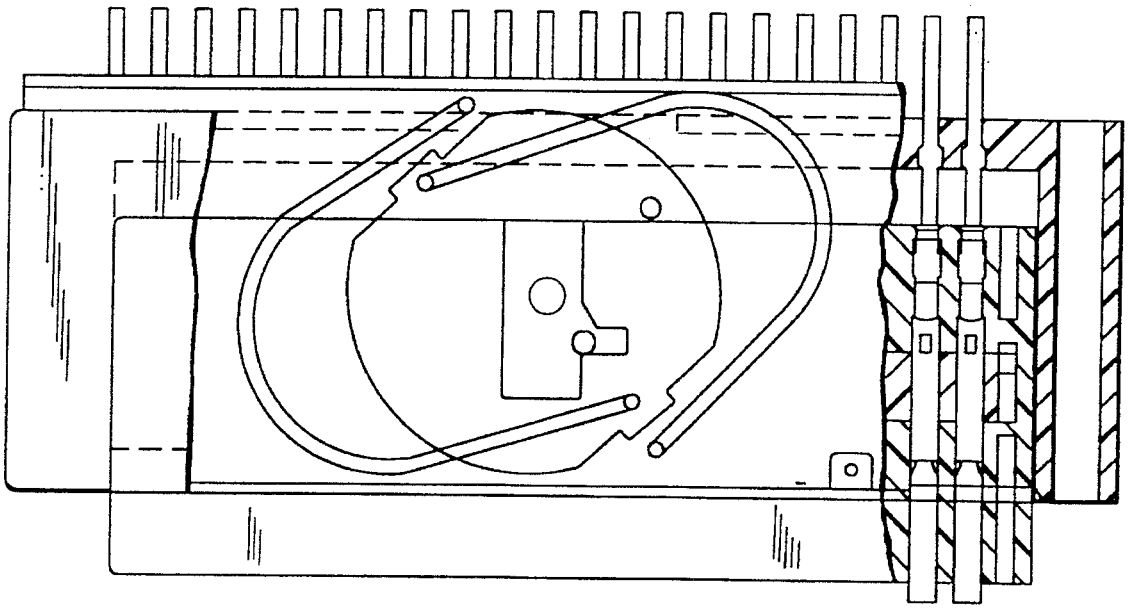
FIG. 11 is a partially cutaway plan view for explaining a coupling step of the connectors of the first embodiment.
Figure 12:
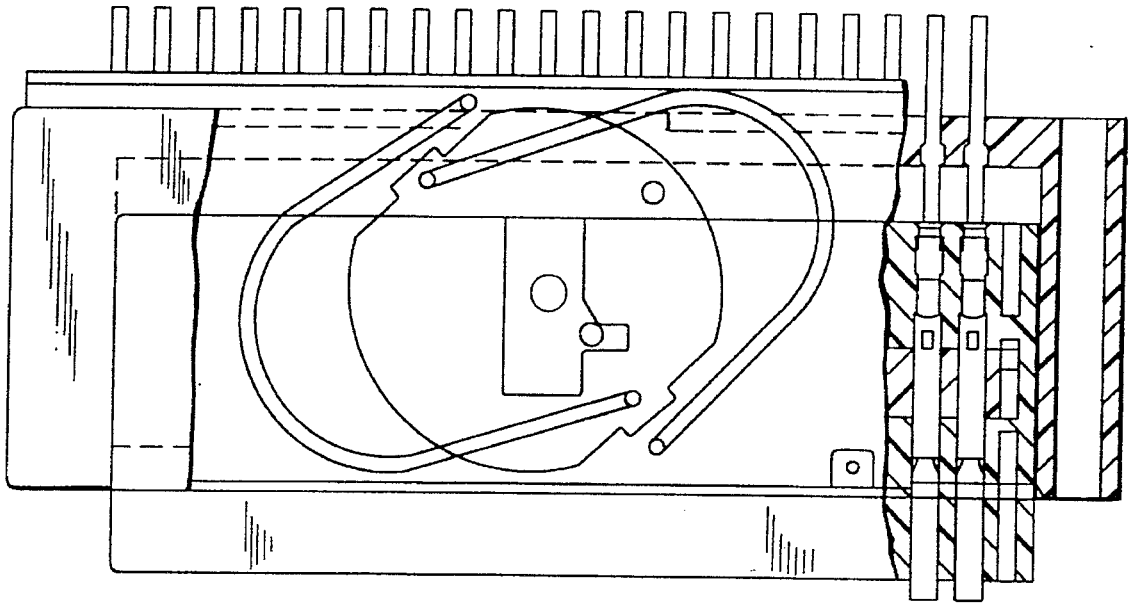
FIG. 12 is a partially cutaway plan view for explaining a coupling step of the connectors of the first embodiment.

The male housing is further inserted into the female housing. In this case, the leaf springs 40A and 40B expand during pivotal movement of the pivotal plate. For this reason, the pivotal plate must be pivoted against the forces of the leaf springs. A state (predetermined intermediate cooling state) shown in FIGS. 9 and 10 is set. When the male housing is further inserted, the state is shifted to a state in FIG. 12 through a state in FIG. 11. The leaf springs contract from the state in FIG. 12. The pivotal plate receives counterclockwise forces from the leaf springs. For this reason, from the state in FIG. 12, the pivotal plate is pivoted counterclockwise without applying an external force to the housings. The leaf springs act to receive the male housing.

Figure 13:
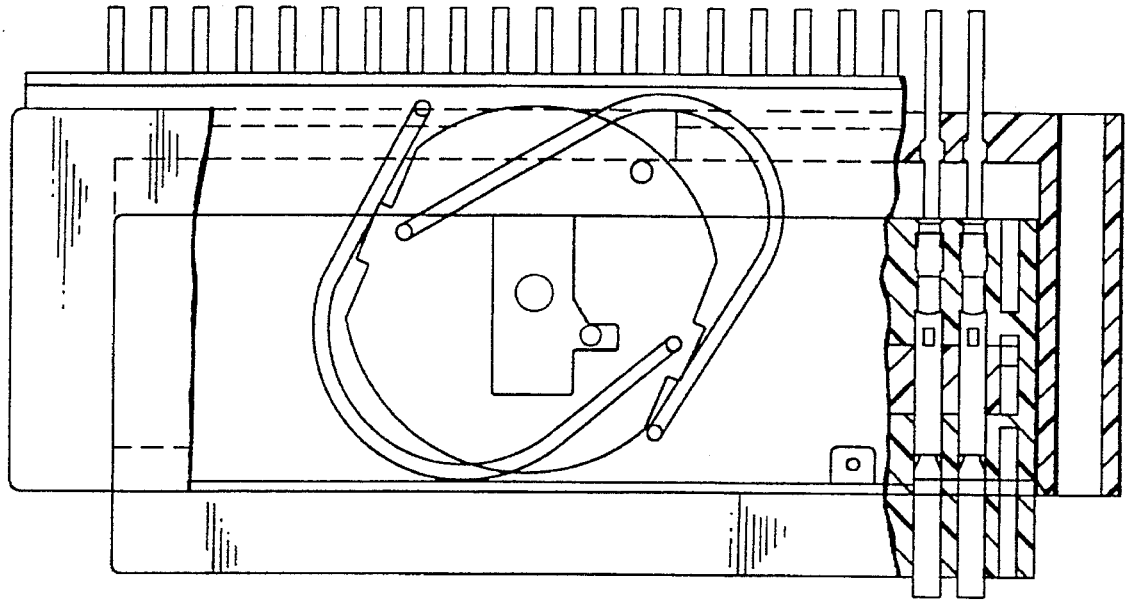
FIG. 13 is a partially cutaway plan view for explaining a coupling step of the connectors of the first embodiment.
Figure 14:
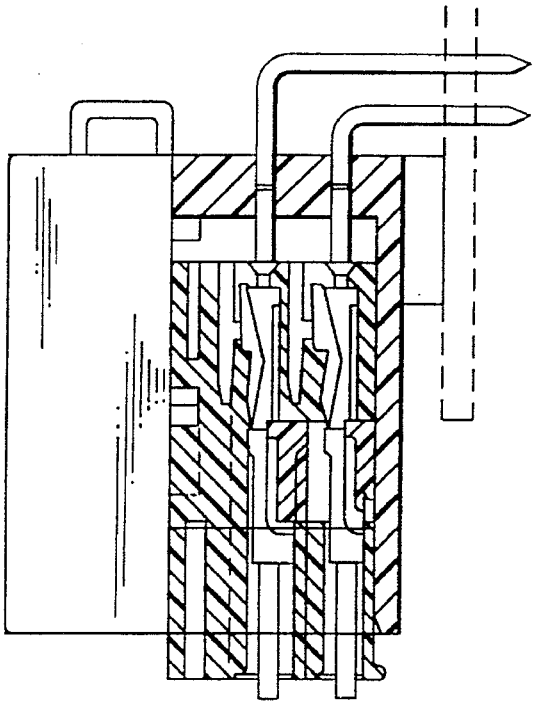
FIG. 14 is a partially cutaway side view for explaining a coupling step of the connectors shown in FIG. 13.
Figure 15:
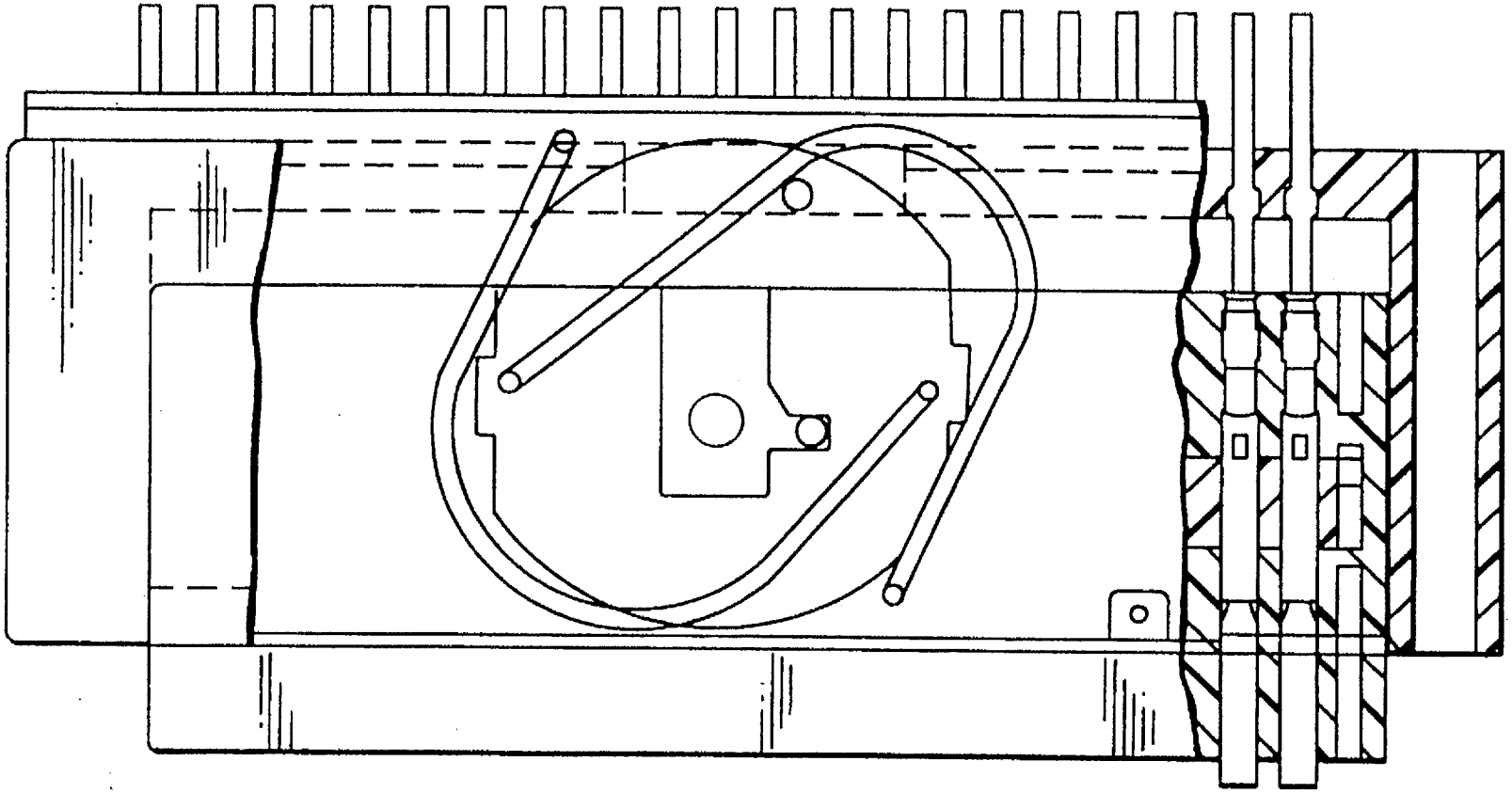
FIG. 15 is a partially cutaway plan view for explaining a coupling step of the connectors of the first embodiment.

When the pivotal plate is pivoted to reach a state in FIGS. 13 and 14, the female and male contacts start to be brought into contact. The insertion forces of the springs are maximized in a state shown in FIG. 15. The connections of the female and male contacts and coupling between the two housings are completed in state shown in FIG. 17.

When the pivotal plate is located at a coupled position (set state) of the two housings although the two housings are kept separated from each other (reset state), i.e., when the pivotal plate is erroneously pivoted to reach a state in FIG. 16 in the reset state, the engaging pin is kept disengaged from the latch groove in this embodiment when the pivotal plate is erroneously pivoted before the two connectors are coupled to each other, the two connectors cannot be coupled, and erroneous insertion of the connection can be prevented.

FIGS. 18 to 21 show the process for separating the two coupled connectors from each other by a reset-lever.

Figure 20:
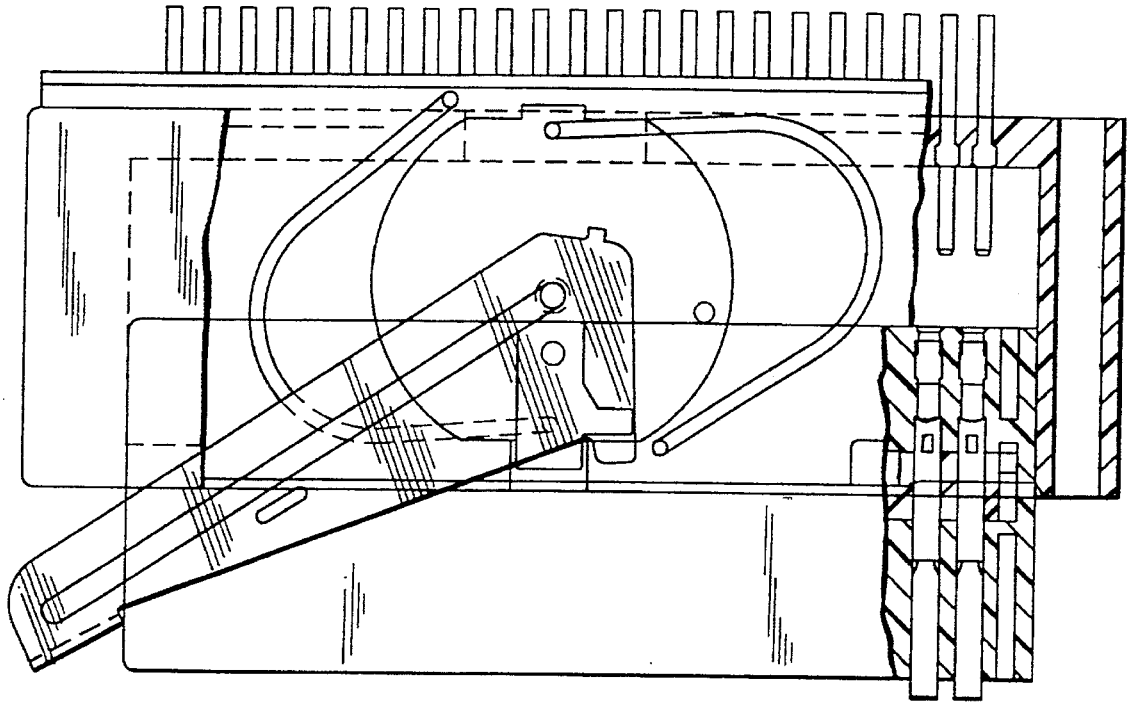
FIG. 20 is a partially cutaway plan view for explaining aa step of separating the coupled connectors of the first embodiment.
Figure 21:
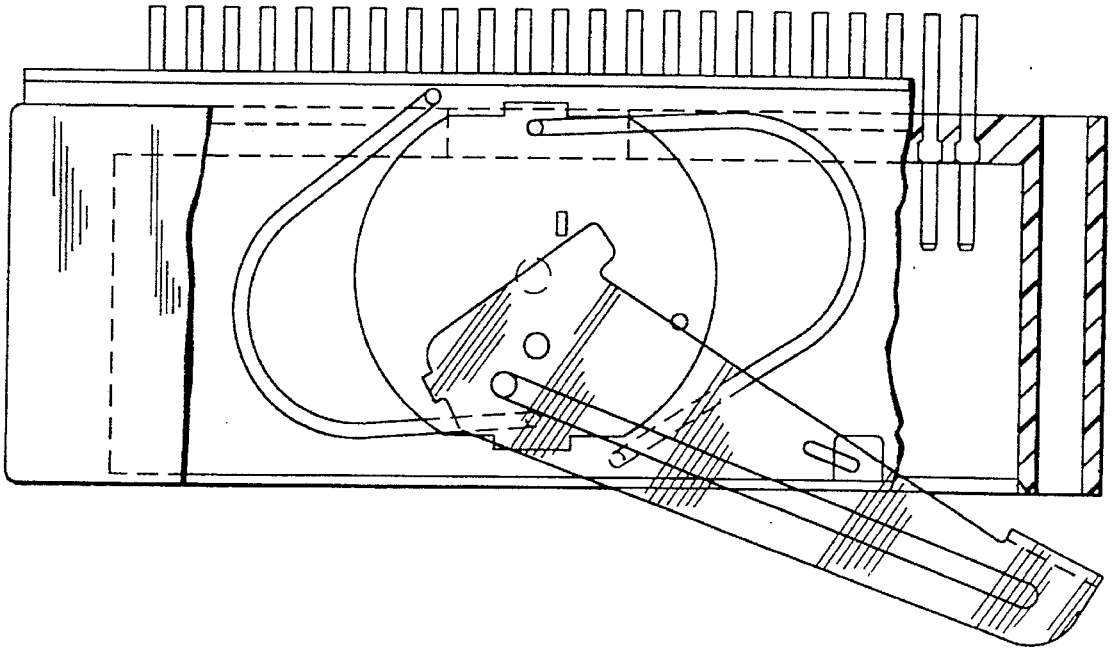
FIG. 21 is a partially cutaway plan view for explaining a step of separating the coupled connectors of the first embodiment.

Referring to FIGS. 18 to 21, the lever 50 is pivotally supported at a position (i.e., the base 35D formed at the edge of the pivotal plate) eccentric with respect to the rotating shaft of the pivotal plate. One end 51 of the proximal portion of the lever is pivoted clockwise, the pivotal plate is pivoted clockwise accordingly to reach a state in FIG. 19. The other end of the proximal portion of the lever is brought into contact with one of the leaf springs to expand it, so that the housing is removed outside the reception range of the leaf springs. The state is then shifted to a state in FIG. 20, so that the two connectors are separated from each other. The lever is then pivoted counterclockwise to set an initial state, as shown in FIG. 21 (i.e., the state is restored to the state in FIGS. 6 and 7).

Figure 22:
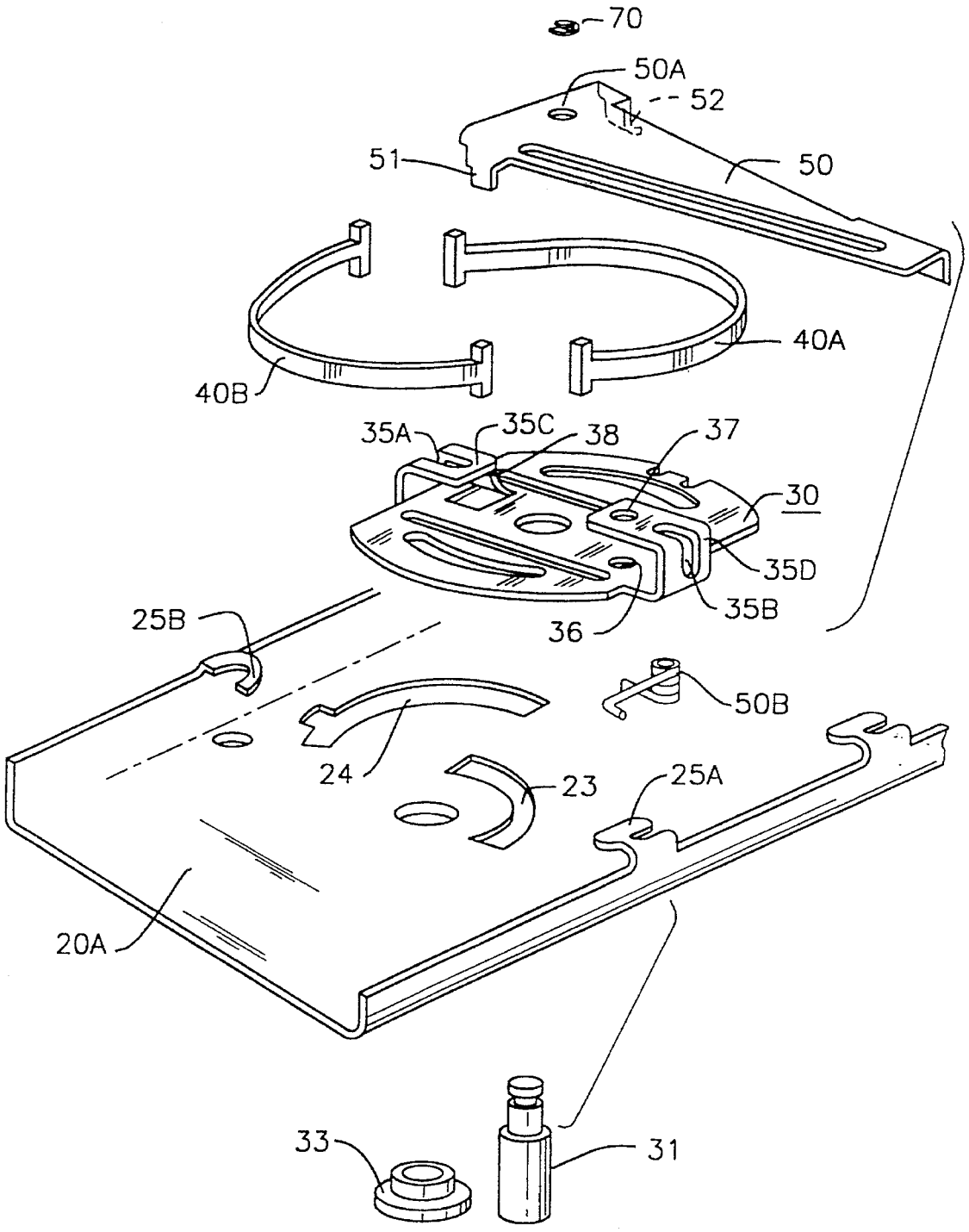
FIG. 22 is a exploded view of a portion of a female connector of the second embodiment.

FIG. 22 shows the essential elements of the second embodiment of the present invention. This embodiment is substantially the same as the first embodiment, except that a reset-lever 50 is mounted on a pivotal plate 30 through a coil spring 50B. In the illustrated embodiment, the coil spring 50B is wound on an engaging pin 31. The two ends of the spring are engaged with one end 51 of the lever and a pivot 33 for the pivotal plate. The return force of the coil spring is set not to adversely affect the operations of the leaf springs.

Figure 23:
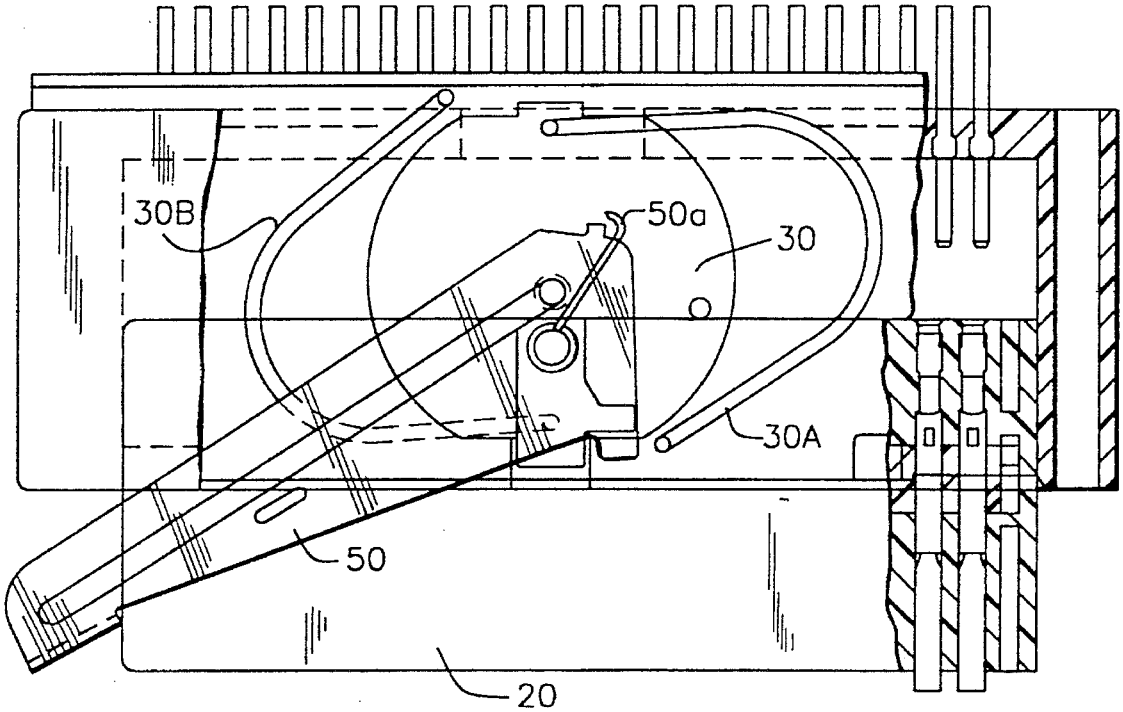
FIG. 23 is a partially cutaway plan view for explaining a step of separating the coupled connectors of the second embodiment.
Figure 24:
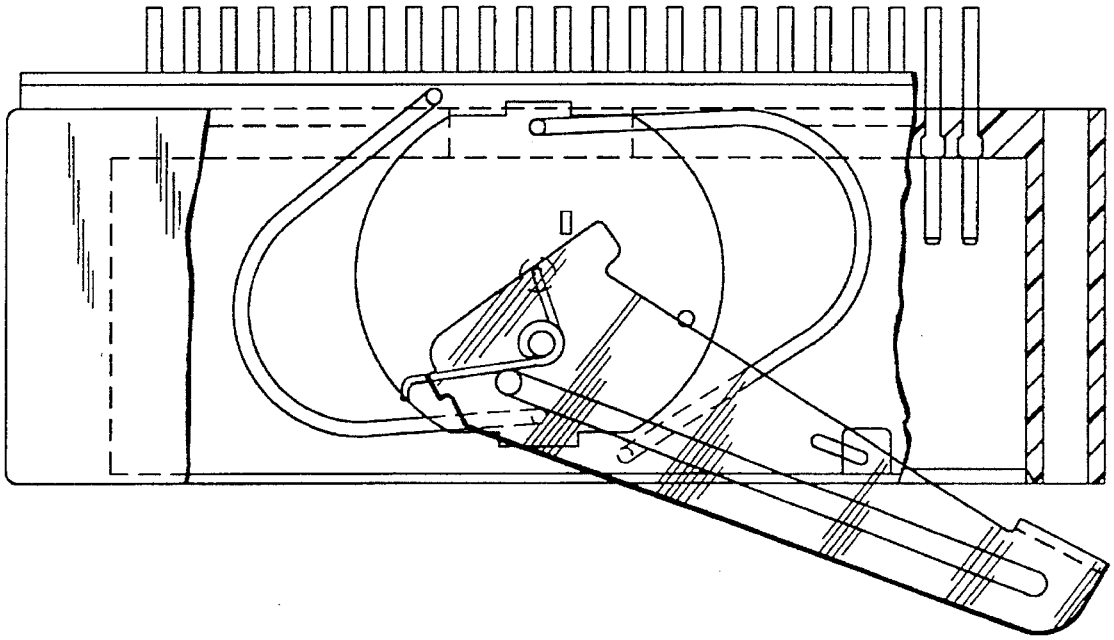
FIG. 24 is a partially cutaway plan view for explaining a step of separating the coupled connectors of the second embodiment.

FIG. 23 is a view corresponding to FIG. 20 illustrating the housing separation process of the first embodiment. FIG. 24 shows a state in which the initial state is automatically restored upon operation of the lever and its release. With this arrangement, the lever can be properly reset after separation of the two housings by means of the lever is completed.

Figure 25:
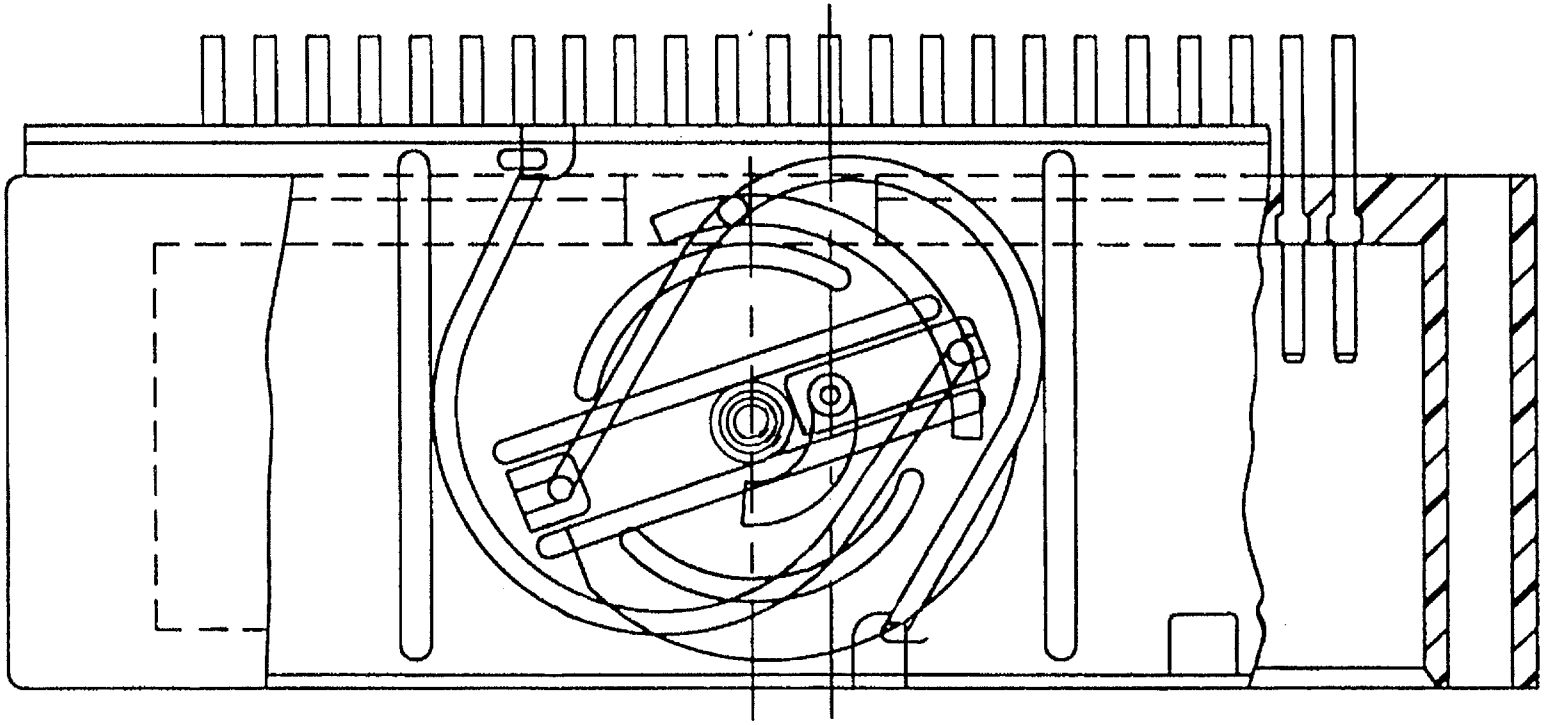
FIG. 25 is a partially cutaway plan view for explaining a coupling step of the connectors of the third embodiment.
Figure 26:
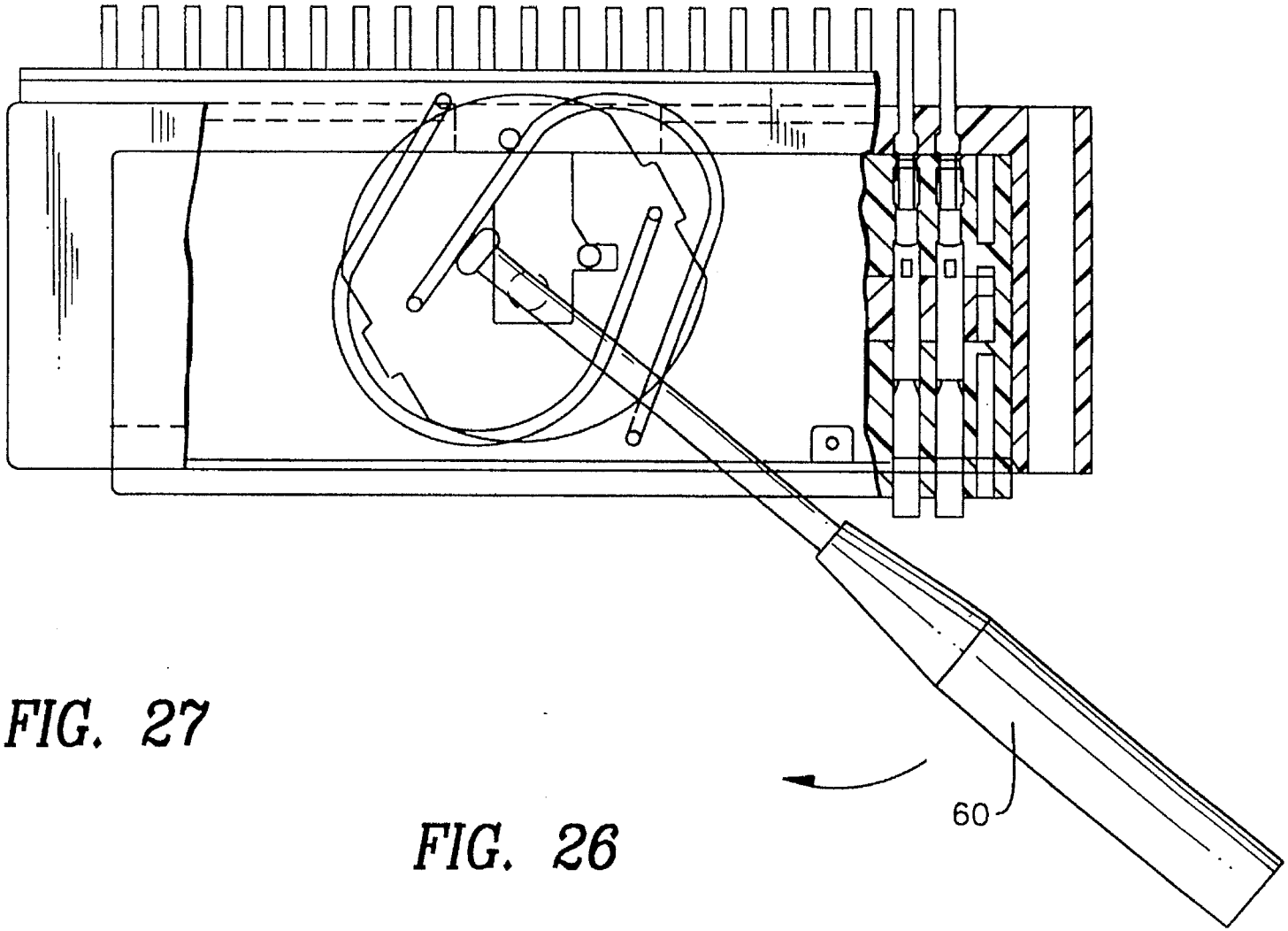
FIG. 26 is a partially cutaway view for explaining a step of separating the coupled connectors of the third embodiment.
Figure 27:
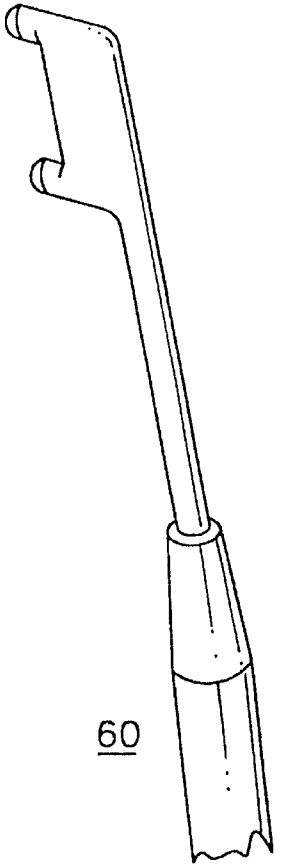
FIG. 27 is a perspective view of a portion of an external operation member for separating the connectors shown in FIG. 26.
Figure 28:
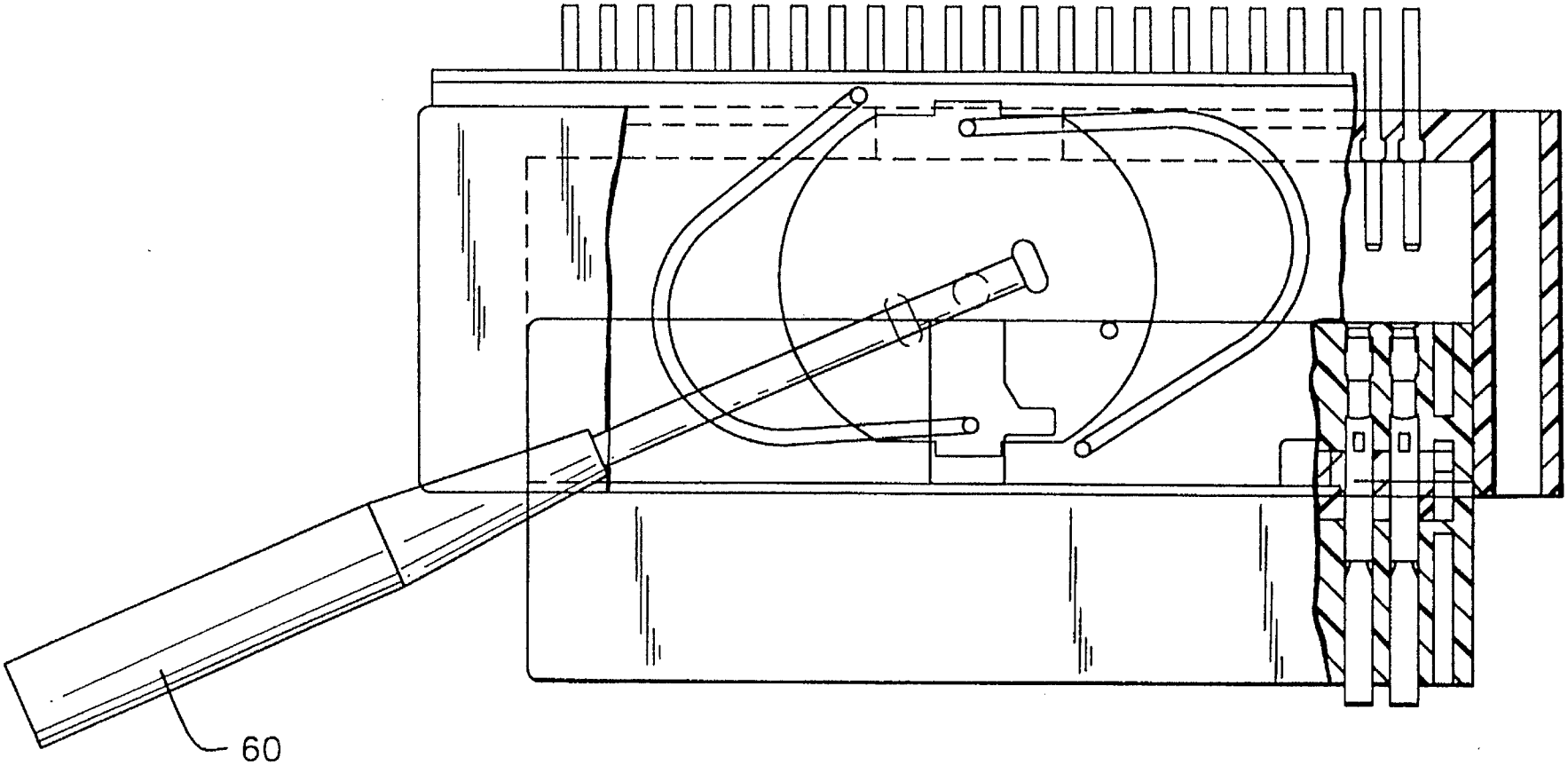
FIG. 28 is a partially cutaway view for explaining a set of separating the coupled connectors of the second embodiment.

FIG. 25 shows the third embodiment of the present invention. The third embodiment is substantially the same as the first embodiment, except that a lever is omitted. In the third embodiment, an operation member 60 which is externally operable is used in place of the lever. The operation member 60 is engaged with a pair of holes 39 formed in part of the pivotal plate so as to separate the two coupled connectors. The operation member 60 is operated to pivot the pivotal plate in a direction opposite to a direction to couple the two housings, as shown in FIG. 26. FIG. 27 shows the external operation member used in this case. As shown in FIG. 27, the external operation member has a pair of projections respectively corresponding to the holes 39 of the pivotal plate. FIG. 28 shows a state in which separation is completed.

Figure 29:
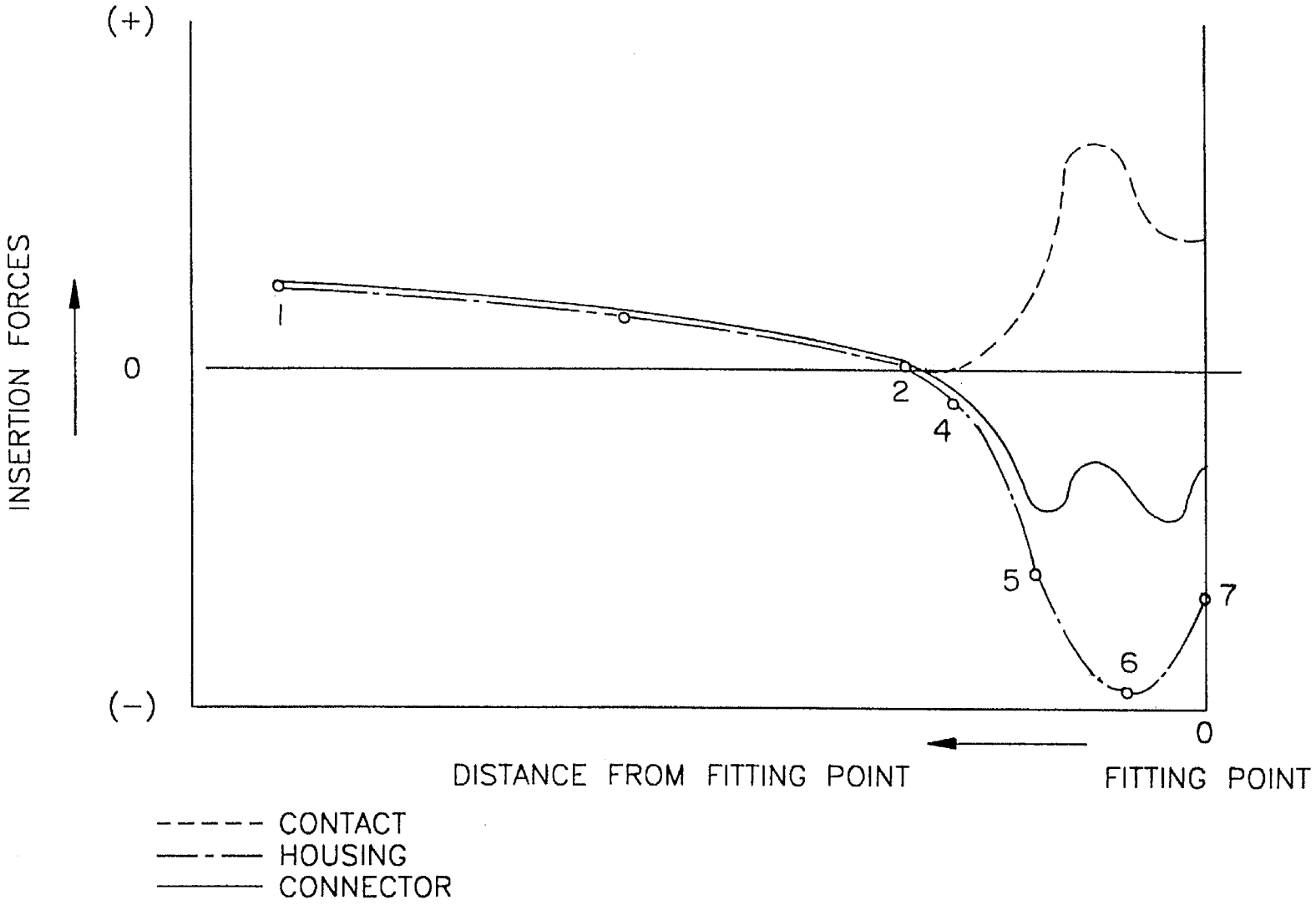
FIG. 29 is a graph showing the relationship between the distance of the connector according to the present invention from a reference position and an inserting force of the connector.

FIG. 29 shows the relationship between the connector insertion forces, the forces received by the female connector (male housing), and a distance from a fitting point (connector reference position upon completion of coupling) in the process for coupling the two connectors to each other. Referring to FIG. 29, point 1 corresponds to FIGS. 7 and 8; 2, FIGS. 9 and 10; 3, FIG. 11; 4, FIG. 12; 5, FIGS. 13 and 14; 6, FIG. 15; and 11, FIGS. 16 and 17.

As is apparent from FIG. 29, the connector insertion force becomes zero at point 3. External connector insertion forces are required at points 1 and 2. The connector insertion forces at point 4 and subsequent points are negative, that is, no external force is required. Insertion and contact connections can be completed by only the forces from the leaf springs.

In a connector according to the present invention, to couple two housings to each other, after these two housings reach a predetermined intermediate coupling state, a pivot plate is pivoted by the actions of the leaf springs, thereby completing coupling between the two housings. At the same time, the two housings are properly latched. Therefore, a so-called half fit state can be prevented.

The connector coupling operation can be performed once in one direction, and any special jig need not be used, thereby facilitating the operation.

The contacts will not be brought into contact with each other until the two housings reach the predetermined intermediate coupling state (i.e., until a housing reception force starts to act). For this reason, the contacts will not be brought into contact with each other in the half fit state.

The insertion force required to insert one connector to the other connector can be simply applied until the predetermined intermediate coupling state is reached. For this reason, only a small insertion force is required (an external force required for connecting the contacts to each other need not be applied).

Arcuated leaf springs having a simple shape are used for the springs in a reception mechanism, and the required number of springs is only two. A required stress can be halved, thereby providing a compact, low-profile connector.

When the two springs are used, each component receives a well-balanced spring force, and the operation of each component becomes stable.

Connector separation is performed by pivoting the lever, and at the same time, the reception mechanism is reset to prevent an operation for inhibiting a fitting operation.

Having described the preferred embodiments of the subject invention, it can be appreciated that variations may be made thereto without departing from the scope thereof. As such, the preferred embodiments are considered illustrative rather than limiting. The true scope of the invention is set forth in the claims appended hereto.

What is claimed is:

1. A connector comprising first and second housings (10) (20) detachably coupled to each other, a pivotal plate (30) pivotally mounted to one of said two housings, a pair of leaf springs (40A, 40B) interposed between one of said two housings and said pivotal plate, and latch means (12) for locking said two housings, said latch means comprising an engaging pin (31) extending from said pivotal plate, and a latch groove (12) formed in one of said two housings, wherein when said first and second housings are coupled, said leaf springs act to pivot the pivotal plate which in turn causes coupling of the first and second housings, and wherein when said pivotal plate is in a set state and said first and second housings are in a reset state, said latch means interferes with coupling of said two housings.

2. A connector according to claim 1, wherein said lever is mounted on said pivotal plate by a coil spring (50B) in order to automatically return to an initial position upon completion of the actuation of said lever.

3. A connector according to claim 1, wherein said springs (40A), (40B) expand in accordance with a pivotal movement of said pivotal plate before said two housings reach the predetermined intermediate coupling state, and contracts when said two housings pass a predetermined coupling state.

4. A connector according to claim 1, wherein when said pivotal plate is at the position of the set state and said two housings are in the reset state, said engaging pin (31) and said latch (12) do not engage each other.

5. A connector according to claim 1, further comprising a reset-lever (50) coupled to said pivotal plate (30), said lever being actuated to cause said pivotal plate to pivot in a direction opposite to that required in coupling said two housings, to thereby disconnect said two housings.

6. A connector according to claim 5, wherein said pivotal plate includes a pivotal shaft, and wherein said lever is pivotally located on said pivotal plate at an eccentric position relative to said pivotal shaft of said pivotal plate, said lever being actuated to cause said pivotal plate to pivot to disconnect said two housings.

7. A connector according to claim 1, wherein said first housing (10) is a male housing and has a plurality of female contacts (11), and said second housing is a female housing having a hollow portion (22) for receiving said male housing and a plurality of contacts (21) connected to contacts of said male housing in the hollow portion.

8. A connector according to claim 7, wherein said contacts of said two housings are connected to each other after said two housings pass a predetermined intermediate coupling state.

9. A connector according to claim 7, wherein, said engaging pin (31) projects into the hollow portion through a window hole (23) formed in a wall surface defining the hollow portion, and said latch groove (12) is formed in said male housing.

10. A connector according to claim 9, wherein said pivotal plate (30) further has a guide pin (32) projecting into the hollow portion through a guide groove (24) formed in said wall surface defining the hollow portion, and said guide pin slides in said guide groove upon insertion of said male housing in the hollow portion, thereby pivoting said pivotal plate.

11. A connector comprising first and second housings (10,20) detachably coupled to each other, a pivotal plate (30) pivotally mounted to one of said two housings, a pair of leaf springs (40A,40B) interposed between one of said two housings and said pivotal plate, and latch means for locking said two housings, said latch means comprising an engaging pin (31) extending from said pivotal plate, and a latch groove (12) formed in one of said two housings, wherein when said first and second housings are coupled, said leaf springs act to pivot the pivotal plate which in turn causes coupling of the two housings, wherein said first housing (10) is a male housing having a plurality of female contacts (11), and said second housing is a female housing having a hollow portion (22) for receiving said male housing and a plurality of contacts (21) connected to said contacts of said male housing in the hollow portion, said contacts of said two housings being connected to each other after said two housings pass a predetermined intermediate coupling state, and wherein said engaging pin (31) projects into the hollow portion through a window hole (23) formed in a wall surface defining the hollow portion, and said latch groove (12)is formed in said male housing, said pivotal plate further including a guide pin (32) projecting into the hollow portion through a guide groove (24) formed in said wall surface defining the hollow portion, and said guide pin slides in said guide groove upon insertion of said male housing in the hollow portion, thereby pivoting said pivotal plate.

12. A connector comprising:

a first housing;

a second housing detachably coupled to the first housing;

a pivotal plate rotatably mounted to one of said first and second housings;

first and second leaf springs, each of said leaf springs having a first end coupled to opposite sides of one of said first and second housings and a second end coupled to said pivotal plate at opposite sides thereof; and latch means for locking said first and second housings, wherein when said two housings are coupled, the leaf springs act to rotate the pivotal plate which in turn causes the latch means to lockingly couple the two housings;

wherein said first housing is a male housing and has a plurality of female contacts, and said second housing is a female housing having a hollow portion for receiving said male housing and a plurality of contacts connected to contacts of said male housing in the hollow portion;

wherein said engaging pin projects into the hollow portion through a window hole formed in a wall surface defining the hollow portion, and said latch groove is formed in said male housing; and wherein said pivotal plate further has a guide pin projecting into the hollow portion through a guide groove formed in said wall surface defining the hollow portion, and said guide pin slides in said guide groove upon insertion of said male housing in the hollow portion, thereby pivoting said pivotal plate.

13. A connector according to claim 12, wherein the latch means comprises an engaging pin extending from said pivotal plate and a latch pin on said pivotal plate, and a latch groove formed in the other one of said two housings.

14. A connector according to claim 12, wherein said contacts of said two housings are connected to each other after said two housings pass a predetermined intermediate coupling state.

* * * * *